United States Patent [19]

Ward et al.

[11] 4,230,448

[45] Oct. 28, 1980

[54] BURNER COMBUSTION IMPROVEMENTS

[75] Inventors: Michael A. V. Ward; Fred R. Kern, both of Lexington, Mass.

[73] Assignee: Combustion Electromagnetics, Inc., Lexington, Mass.

[21] Appl. No.: 38,434

[22] Filed: May 14, 1979

[51] Int. Cl.[3] ..... F23D 11/45; F23Q 3/00

[52] U.S. Cl. ..... 431/208; 60/736; 219/10.55 R; 219/10.57; 431/8; 431/11; 431/265; 123/536; 123/434; 123/557

[58] Field of Search ..... 431/418, 11, 265; 60/736; 137/336; 123/119 E, 119 F, 122 F; 219/10.55 R, 10.57

[56] References Cited

U.S. PATENT DOCUMENTS

| | | | |
|---|---|---|---|
| 3,326,262 | 6/1967 | Weller et al. | 431/11 |
| 3,694,136 | 9/1972 | Flournoy et al. | 431/265 |
| 3,934,566 | 1/1976 | Ward | 123/119 E |
| 3,976,726 | 8/1976 | Johnson | 123/119 E |
| 4,064,852 | 12/1977 | Fulenwider | 123/122 F |
| 4,067,683 | 1/1978 | Klaila | 431/208 |
| 4,138,980 | 2/1979 | Ward | 123/119 E |
| 4,152,567 | 5/1979 | Mayfield | 219/10.55 R |
| 4,157,700 | 6/1979 | Conner | 123/119 E |
| 4,171,199 | 10/1979 | Henriques | 431/265 |

*Primary Examiner*—George E. Lowrance
*Attorney, Agent, or Firm*—Kenway & Jenney

[57] ABSTRACT

An oil burner with a combustion chamber has a microwave energy source connected to the fuel supply line to heat the fuel and connected to the air supply line to apply an electric field at the nozzle to the fuel spray and the area of combustion in the combustion chamber.

8 Claims, 3 Drawing Figures

BURNER COMBUSTION IMPROVEMENTS

BACKGROUND OF THE INVENTION

The invention relates generally to combustion in burners of principally hydrocarbon-air fuel mixtures, and in particular to methods and apparatus for increasing the efficiency and flame stability of such burners.

The burners typically have fuel transported through a pipe that terminates in a nozzle in the burner combustion chamber. Air is supplied to the area of the nozzle. Combustion is typically initiated by electrodes in the same area.

While such burners, under ideal conditions, can be made to operate efficiently, several factors occur to reduce over-all efficiency. First, burners have limited turn-down ratio (ratio of maximum to minimum heat energy output) resulting in poor match between the burner and the load to be heated. This requires frequent burner shut-off which reduces the over-all efficiency, due to the loss of heat through the large heat capacity of the intermediary heating equipment.

Second, some fuels, principally low BTU fuels, have low flame temperature and are therefore more susceptible to quenching (they are more unstable).

Third, conventional methods of preheating fuel while in the pipe are known to increase the initial rate of vaporization of fuel droplets in the spray leaving the nozzle and to therefore improve combustion. However, there are limits to the amount of pre-heating which can be accomplished while the fuel is confined in the pipe. Chemical decomposition tends to occur for heated fuel, causing part of the fuel to solidify and become attached to pipe and nozzle surfaces. When this happens, the heat transfer rate through the pipe decreases, creating a need for still higher pipe temperature and further compounding the problem.

Additionally it is known that preheating the fuel before injecting it to the burner produces vaporization of the molecules with the highest energy first, which in turn results in the droplet temperature dropping rapidly to below the temperature of the surrounding gas. When the droplet temperature becomes low enough to accept enough heat by radiation from the flame front and by conduction from the surrounding gas, its temperature stabilizes and its rate of evaporation is controlled by these heat transfer mechanisms in a conventional burner. This phenomenon is especially important when the burner output is low. This is true because at low output levels the droplet and all velocities are low and part of a droplet can pass out of the small flame cone and not be vaporized by the flame, resulting in part of the fuel not being combusted. This leads also to the formation of deposits on burner surfaces, increased emissions, and reduced burner heat transfer efficiency. Having less fuel consumed for a given air flow results in lower flame temperatures and attendant lower burner efficiency.

Fourthly, it is known that burners operate more efficiently when running slightly lean (with slightly excess air) because of both more complete combustion and lower emission of smoke. Under rich combustion, emitted smoke coats the heat exchanger surfaces, reducing heat transfer and allowing more heat to escape up the chimney as well as requiring more frequent maintenance. However, since burner flames are more unstable under lean operation and more susceptible to be blown out by variation in environmental conditions, they are typically operated at slightly rich air-fuel ratios (with excess fuel), therefore wasting fuel and producing smoke.

It is clear that it would be desirable to preheat fuel and vapor entering a burner combustion chamber besides electrically stimulating the resulting combustion for optimum operation. Prior art references teach the application of microwave energy to the flame front of a combustion region of an internal combustion engine to stimulate burning. They include (1) Ward, U.S. Pat. No. 3,934,566, where it is shown that for internal combustion the flame-front electron plasma frequency and the electron-neutral collision frequency are in the microwave frequency range and thus have the correct properties insofar as allowing microwave energy to be coupled to the flame-front plasma; (2) Ward application Ser. No. 622,165, where it is shown that use can be made of the metal combustion chamber to improve coupling to the flame front by exciting combustion chamber resonant cavity modes; (3) Ward U.S. Pat. No. 4,138,980 where it is shown that for a typical combustion chamber of the conventional internal combustion engine type, microwave power levels of the order of 100 watts are sufficient to significantly heat flame-front electrons and improve combustion, and (4) Ward application Ser. No. 968,376, where it is shown that for optimal stimulation of the flame, the combustion chamber must be reshaped and/or the microwave mode chosen so that the highest electric fields are maintained at the region of the initial flame front or the region where the flame is most likely to become unstable.

It is an object of the invention to apply microwave energy to burners in ways that will make their combustion more efficient.

It is also an object of the invention to produce a better way to preheat fuel and improve the vaporization for such burners to produce better flame stability and more complete combustion, even at low burner power outputs.

It is another object of the invention to stimulate the combustion region in such burners to increase their flame stability, allowing combustion to occur in a smaller volume and at leaner mixtures.

It is another object of the invention to heat fuel in the pipe leading to such burners solely and indirectly by the application of microwave energy in ways that can complement microwave stimulation of the combustion region. It is another object of the invention to provide for heating of the fuel vapor, or spray, resulting from heated fuel itself.

Other objects of the invention are to increase the efficiency and reliability of combustion in a hydrocarbon fuel burner by methods and apparatus that involve little additional expense and uncomplicated operation.

Other objects and advantages of the invention will be pointed out hereinafter or be readily apparent from the following discussion.

SUMMARY OF THE INVENTION

The invention comprises connecting a microwave energy generator to the fuel supply pipe of a combustion burner. The supply pipe acts as the conductor for the microwave energy, heating fuel on its way to the nozzle of the pipe. In preferred embodiments of the invention microwave energy is also supplied to the air supply ducts surrounding the fuel pipe, to apply microwave energy to the fuel spray and, to some extent, to the combustion region. In other embodiments a wave guide mounted on the end of the air supply duct intensifies the electric field in the vicinity of the combustion region to provide increased flame stimulation.

BRIEF DESCRIPTION OF THE DRAWING

For a fuller understanding of the nature and objects of the invention, reference should be made to the following detailed description and the accompanying drawings, in which.

DESCRIPTION OF THE PREFERRED EMBODIMENTS

Figure 1:
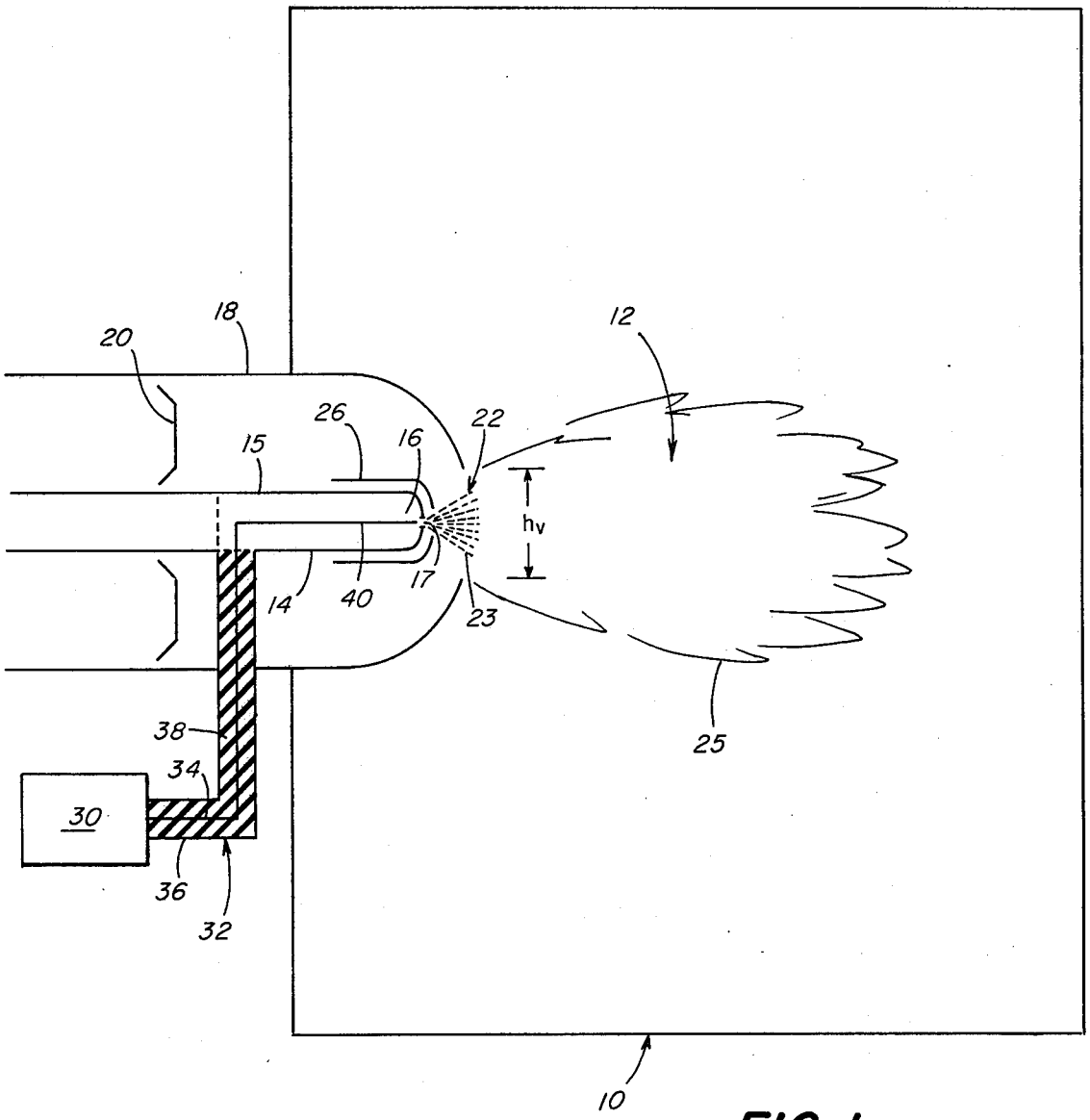
FIG. 1 is a somewhat schematic drawing of a conventional domestic oil burner showing microwave transmission line connectors coupled to the fuel delivery pipe.

FIG. 1 shows schematically principally the front half of a common domestic oil burner. It includes an enclosure or chamber 10 defining the combustion region 12. Leading to the combustion chamber is a fuel pipe 14 made of metal walls 15 terminating in a nozzle 16 having a tip 17. Coaxially surrounding the fuel pipe 14 is a blower air feed duct 18, made of metal, including swirl vanes 20. The duct terminates in a burner mouth 22 having a gap (the width of which is shown as $h_v$) just outside the nozzle 16 at the end of the fuel pipe 14. Ignition electrodes 26 are present just outside the nozzle 16 and inside the burner mouth 22. The elements described thus far are those of a conventional burner.

In the operation of this typical burner fuel oil is present in the fuel pipe 14 under pressure and as a result of the pressure is sprayed out of the nozzle 16 terminating the fuel pipe, where it vaporizes. Air for combustion is meanwhile supplied by the feed duct 18. The spray 23 from the fuel nozzle 16 mixes with the air and is ignited by the electrodes 26. The flame 25 that results extends from the burner mouth 22 into the combustion region 12 of the chamber 10. FIG. 1 shows the elements schematically since the operation of the elements are well known. The electrodes 26, for example, are not shown connected to a source of electrical power, and yet would be so connected in a burner. Neither is an exhaust from the chamber 10 shown. These details, and others, can be readily supplied by anyone familiar with furnaces.

Additionally shown in FIG. 1, however, in accordance with the invention, is a microwave energy generator 30, coupled by way of a coaxial transmission line 32, to the fuel pipe 14. The coaxial transmission line 32 includes central conductor 34 and outside conductors 36 separated by insulation 38. The outside conductor 36 of the transmission line 32 is coupled to the metallic wall 15 of the fuel pipe 14 itself. The pipe 14 then acts as a continuation of the outside conductor 32. The central transmission line conductor 34 is coupled to a pipe central conductor 40 located along the axis of the fuel pipe 14. This central conductor 40 is terminated in the nozzle tip 17 and is electrically ungrounded so as to produce an electrically open end region of high electric field for maximum microwave heating of the fuel in the pipe 14.

In operation, fuel passing through the pipe 14 toward the nozzle 16 is heated by the microwave electric field generated within the pipe. The fuel is heated efficiently and thoroughly, fuel in the center of the pipe being heated as thoroughly as that near the pipe wall 15. Heating of the fuel increases vaporization of the fuel as it leaves the nozzle and is mixed with the air. It thereby leads to more complete combustion in the combustion region 12.

Figure 2:
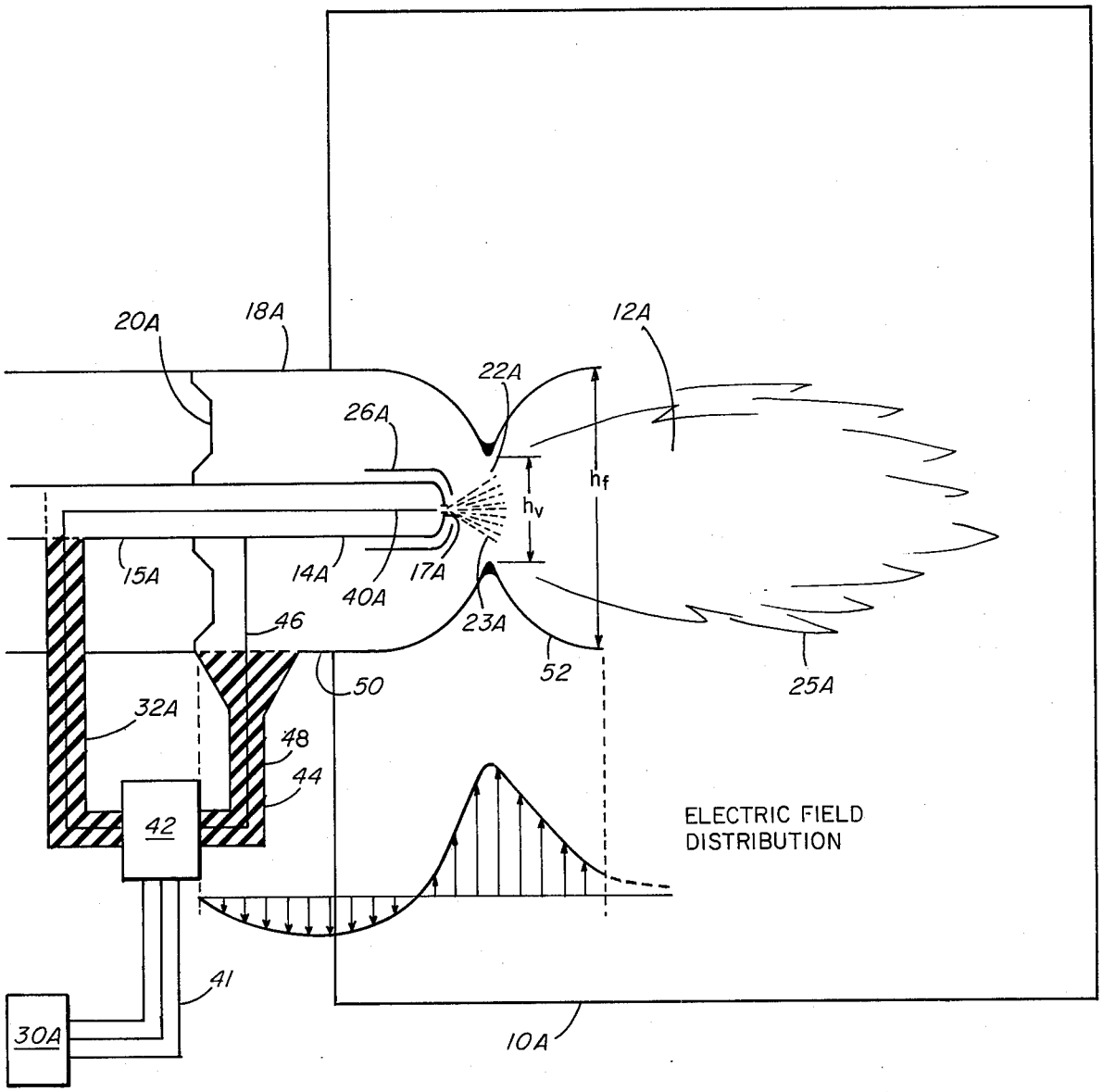
FIG. 2 is a similar drawing, showing in addition microwave transmission line connectors coupled to the blower feed air duct and including a tubular (waveguide) section added to the end of the blower feed air duct; in addition a graph of electric field intensity vector in the air duct is superimposed on the drawing.

In FIG. 2, the same burner is essentially illustrated, with some additional microwave energy connections. The same elements performing the same functions as they do in FIG. 1 are denominated with numerals as in FIG. 1, followed by the letter A. In the arrangement shown in FIG. 2, a microwave generator 30A supplies microwave energy also to the fuel vapor 23A and the flame 25A in the combustion region 12A. The microwave generator 30A is, however, connected via transmission line 41 to a control box 42 in this arrangement that divides the energy between a coaxial transmission line 32A leading to the fuel pipe 14A in the same way as in the arrangement shown in FIG. 1, and another transmission line 44. This other transmission line 44 couples its center conductor 46 to the pipe 14A and its outside conductor 48 to the wall 50 of the coaxial air duct 18A, making a coaxial transmission line out of those two parts of the burner system.

The air duct 18A terminates at the mouth 22A of the blower. However, a microwave waveguide 52 of tubular form is added to the air blower mouth 22A to extend the region of electric field to deeper parts of the flame 25A. The microwave frequency and/or the diameter $h_f$ of the waveguide 52 are chosen so that the waveguide 52 is near cut-off and the microwave waveguide wavelength is large. The microwave waveguide 52 is added to the end of the air duct 18A, to flare out to a tubular section having a diameter $h_f$ larger than the diameter of the burner mouth, $h_v$, to extend the region of high electric field to deeper parts of the flame. The high electric field therefore encompasses the entire region of mixing of air and fuel spray 22A and a substantial portion of the flame region 25A about the initial flame front region, as shown by the graph superimposed on the drawing.

Figure 3:
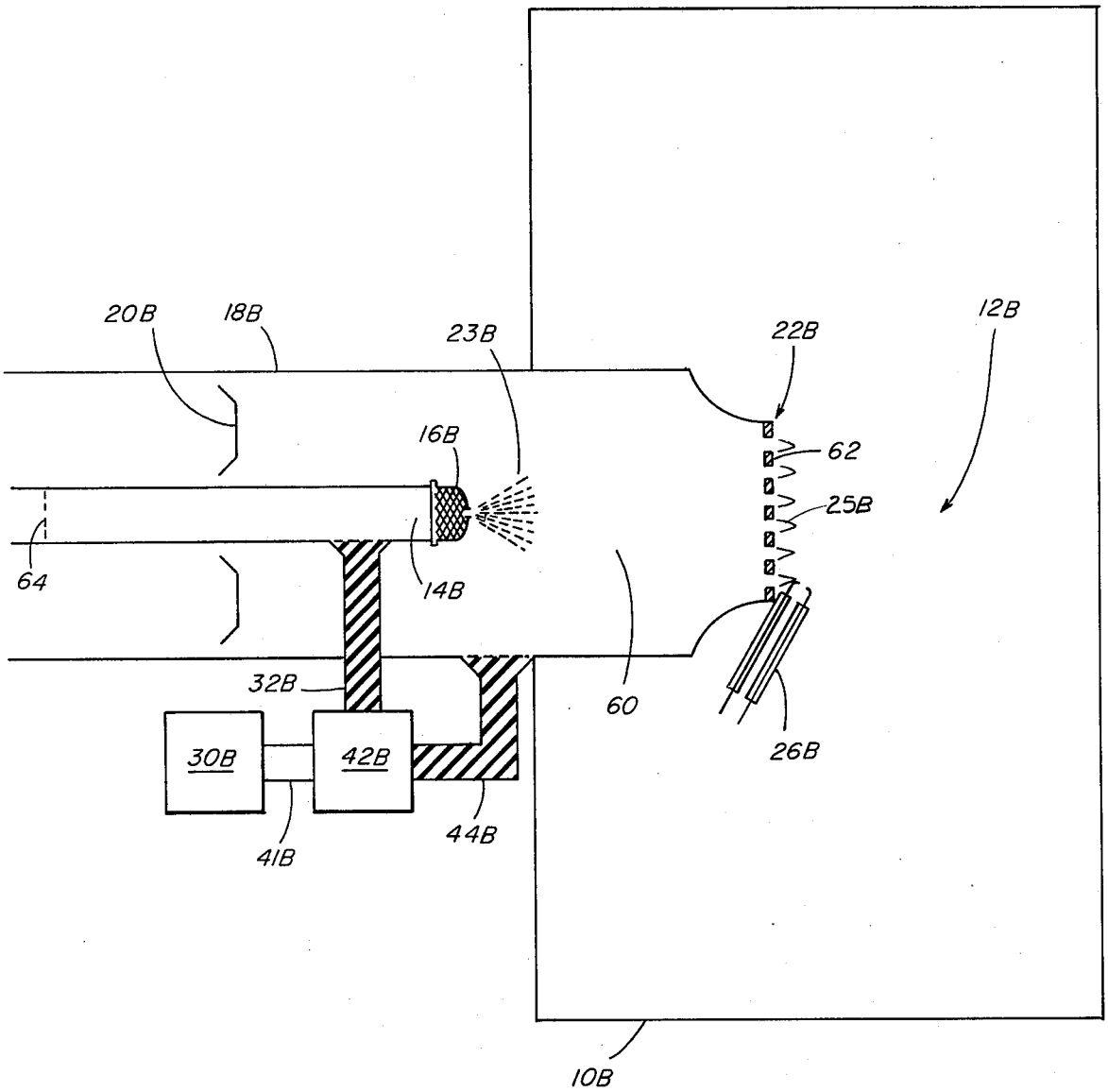
FIG. 3 is a similar drawing in which the microwave coupling means are in the form of waveguides.

FIG. 3 shows a burner in which the fuel and air transporting mechanisms have been modified so that they may act as microwave energy means transmitting waveguides. A microwave energy generator 30B supplies energy via a transmission line 41B to a control box 42B. As in the embodiment described in FIG. 2, control box 42B divides the energy between a transmission line 44B directed toward the air duct 18B and a transmission line 32B directed toward the fuel pipe 14B. In this case, however, the transmission lines are waveguides and not coaxial transmission lines. The burner elements 14B, 18B act as waveguides also; their dimensions and the microwave frequency must, of course, have the appropriate relationship to each other.

The air supply tube 18B is modified to not reduce to a mouth so quickly near the nozzle 16B terminating the fuel pipe 14B, but instead to continue as a waveguide structure 60 defining an enlarged air and spray region 23B into which microwave energy is transmitted. Furthermore the air supply/waveguide 18B ends in a mouth 22B having a mesh 62 of electrical insulation material, and the ignition electrodes 26B are located just outside the mouth 22B, rather than inside.

The amount of microwave energy radiated through the mouth 22B into the flame region 25B will depend on the microwave wavelength relative to the waveguide diameter. The dimensions and/or the microwave frequency can be chosen so that high electric fields are maintained just outside the fuel pipe nozzle 23B, just outside the flame region 25B, and in the middle of the combustion chamber 12B. The pipe 14B is such that maximum fields will be maintained at the nozzle 16B which is either isolated from the pipe or made of non-conducting material to produce maximum heating of fuel just prior to the ejection into the flame region 25B. By appropriately arranging the pipe 14B the heating effect of the microwave energy will be distributed to lesser or greater lengths of the fuel pipe. If wire mesh 64 is located back at some distance on the pipe 14B across the throat of the pipe the microwave heating will be distributed between the wire mesh 64 and the nozzle 16B. By appropriate design of the pipe 14B, pipes ordinarily inaccessible to conventional heating can have their contained fuel heated with microwaves. Furthermore by appropriate choice of the waveguide mode, one can maximize heating of the fuel at the center of the tube by choosing a mode with maximum electric field at the center, which will maximize the total heating rate possible while preventing the oil from decomposing on the pipe wall.

The embodiments demonstrate the application of microwave energy to fuel to heat it and allow its more rapid vaporization, to the vapor itself, and to the flame front. There are certain considerations in the application of the energy that should be discussed.

Typically the applied microwave power ought to bear a relationship to the burner heat power output such that the microwave power in is somewhere between 2% and 0.02% of the burner power output. Commercial magnetrons operating at 0.915 GHz and 2.45 GHz are the presently most prevalent principal sources of microwave power, although other microwave heating frequencies such as 5.8 GHz, 22 GHz can be used. The useful microwave electromagnetic frequency range is $3\times10^8$ to $3\times10^{10}$ Hz.

An important parameter when considering coupling microwave power to fuel or to the flame plasma is Q, the quality factor. Q is the ratio of energy stored in a system to the energy lost or absorbed per oscillation of the field. A low value of Q means a high absorption of energy by the material, which means that it is heated. In a system with several elements having different values of Q, those with the lowest value will tend to absorb more energy. It is therefore desirable in devising a system that requires the absorption of energy by a component to have that component have a low value of Q.

The Q-value for the present application where the absorptive material (fuel and flame plasma) is contained in a resonant structure is:

$$Q \simeq \frac{\int\int\int_V dV\epsilon'_r\vec{E}\cdot\vec{E}^*}{\int\int\int_{\Delta V} dV\epsilon''_r\vec{E}'\cdot\vec{E}'^*}$$

where Q is the quality factor of the resonant (conductive) structure containing lossy material, $\epsilon_r''$ is the imaginary part of the relative complex dielectric constant, $\epsilon_r'$ is the real part of the relative complex dielectric constant, $\vec{E}$ is the electric field in the resonant structure, $\vec{E}'$ is the electric field in the region of the lossy material, V is the volume of the resonant structure, and $\Delta V$ is the volume of lossy material.

It must be appreciated that both fuel and flame plasma are not very lossy so that in the transfer of microwave energy to them, microwave energy should be stored resonantly in a burner structure. The above referred to Q relates to the Q of the burner structure so excited with microwaves and loaded by the lossy material. The three cases, heating fuel, fuel vapor, and flame plasma, will now be discussed.

(1) Heating of fuel $$Q_{Fuel}\simeq\epsilon_r'/\epsilon_r''$$

since $\Delta V\simeq V$ in this case (i.e., the resonant structure is the fuel-containing pipe made into a resonant transmission line by adding a central wire which does not significantly impede the flow of oil and which behaves as the center conductor of the transmission line, as in FIGS. 1 and 2). For large diameter fuel pipes the added central conductor may be unnecessary if the oil filled pipe behaves as a circular waveguide above cut-off (as in FIG. 3).

(2) Heating of fuel spray (droplets and vapor)

$$Q_{Vapor}\simeq\frac{1}{\epsilon_r''}\cdot\frac{V}{\Delta V}\cdot\frac{E^2_{AVE}}{E'^2}$$

where it is assumed that:

(a) $V>>\Delta V$ and hence $\epsilon_r'\simeq\epsilon_o$ (b) the electric field is approximately constant over $\Delta V$ (c) $\int\int\int_V dVE^2\simeq VE^2_{AVE}$ where $E_{AVE}$ is an "average" electric field, equal to $$\frac{1}{\sqrt{2}}E_o$$

for a sinuosoidal distribution ($E_o$=peak electric field for a sinusoidal distribution)

(3) Heating of the flame plasma $$Q_{Flame}\simeq\frac{1}{\epsilon_r''}\ \frac{V}{\Delta V}\ \frac{E^2_{AVE}}{E'^2}$$

which is similar to case (2).

Both $Q_{Vapor}$ and $Q_{Flame}$ can be simplified by noting that:

$$E'^2=E'^2_{Tan}+E'^2_{Norm}$$

$E'_{Tan}$=Electric field tangential to lossy material $E'_{Norm}$=Electric field normal to lossy material Applying boundary conditions:

$$E'_{Tan}=E_{Tan}$$

$$E'_{Norm}=(1/\epsilon_r)E_{Norm}$$

It can be shown that:

$$E'^2=E^2_{Tan}+\frac{1}{\epsilon_r'^2+\epsilon_r''^2}E^2_{Norm}$$

We will now assume that on the average the electric field is as likely to be tangential as it is normal to the flame front, i.e., $$E^2_{Tan} \simeq E^2_{Norm} = \tfrac{1}{2} E^2$$

$$E'^2 = \tfrac{1}{2} E^2 (1 + \frac{1}{\epsilon_r'^2 + \epsilon_r''^2})$$

$$E'^2 = \frac{1 + \epsilon_r'^2 + \epsilon_r''^2}{2(\epsilon_r'^2 + \epsilon_r''^2)} E^2$$

Recall that:

$[\epsilon_r']$Vapor$\simeq 2$ $[\epsilon_r'']$Vapor$<<1$ $[\epsilon_r']$Flame$\simeq 1$ $[\epsilon_r'']$Flame$\simeq 0(1)$(order of one)

so that we can write:

$$[E'^2] \text{ Vapor} \simeq \frac{1 + \epsilon_r'^2 E^2}{2\,\epsilon_r'^2}$$

$$[E'^2] \text{ Flame} \simeq \frac{2 + \epsilon_r''^2 E^2}{2 + 2\epsilon_r''^2}$$

Hence, we can finally write:

$$Q_{Fuel} \simeq \epsilon_r'/\epsilon_r''$$

$$Q_{Vapor} \simeq \frac{2\,\epsilon_r'^2}{1 + \epsilon_r'^2} \cdot \frac{1}{\epsilon_r''} \cdot \frac{V}{\Delta V} \cdot \frac{E^2_{AVE}}{E^2}$$

$$Q_{Flame} \simeq \frac{2 + 2\,\epsilon_r''^2}{2 + \epsilon_r''^2} \cdot \frac{1}{\epsilon_r''} \cdot \frac{V}{\Delta V} \cdot \frac{E^2_{AVE}}{E^2}$$

As the way of an example, the following typical values are taken:

$[\epsilon_r']$ Fuel, $\simeq 2$,
Vapor
$[\epsilon_r'']$ Fuel, $\simeq .01$,
Vapor since most fuels will be more contaminated than cable oil.

$[\epsilon_r'']$Flame$\simeq 1$

Hence:

$$Q_{Fuel} \simeq 200$$

$$Q_{Vapor} \simeq 160 \frac{V}{\Delta V} \frac{E^2_{AVE}}{E^2}$$

$$Q_{Flame} \simeq \frac{4}{3} \frac{V}{\Delta V} \frac{E^2_{AVE}}{E^2}$$

To place these figures in context, a value for Q of 100 for a material generally means it is relatively easy to heat with microwave energy, a value of 1000 means it is difficult to heat, and a value of 10,000 means it is almost impossible.

Typically, $V/\Delta V$ is a large number and $E^2_{AVE}/E^2$ is of order one (0(1)), although it can be made moderately small.

In order to interpret the above relations, one should recognize the following points with regard to microwave heating of low loss material.

(1) Power absorbed by material is proportional to the electric field strength squared ($E^2$);

(2) For a given microwave power level P, supplied to a structure of quality factor Q, the following holds:

$$E = C\sqrt{P \cdot Q}$$

where C is a constant of order 10, i.e., typically $1 \leqq C \leqq 100$.

(3) In the absence of lossy material, the (empty) metallic cavity structure (burner in this case) will have a Q (denoted as $Q_o$) of order 1000 at microwave frequencies, i.e., $100 < Q_o < 10{,}000$. This $Q_o$ is due to wall heating produced by the flow of microwave current along the surface of the metallic burner walls which have a high but nonetheless finite electrical conductivity.

(4) The percent of microwave power absorbed by the lossy material (of quality factor Q) is clearly given by:

$$\frac{Q_o \times 100\%}{Q_o + Q}$$

We can see that, for a given microwave power level P, one obtains best heating results if high electric fields are maintained through high Q. But too high a Q results in wall heating. Taking our criterion for efficient microwave heating as that where at least half the microwave power is transferred to the lossy material, we require that:

$$Q \leqq Q_o$$

It is an immediate consequence that the fuel and flame plasma can be very efficiently heated, but problems exist in heating the vapor. However, since the vapor and flame plasma are heated simultaneously, one can design the burner such that:

$$Q_{Flame} \leqq Q_o$$

$$E^2_{Vapor} >> E^2_{AVE}$$

i.e., the structure is designed such that the intermetal gap h is small in the region of the vapor ($h_v$) and moderate in the flame ($h_f$). Intuitively, one has:

$$E_V/E_F \simeq h_f/h_v$$

so that the very low absorptivity of the vapor can be in part compensated by having a large ($E^2/E^2_{AVE}$) ratio.

But most burners characteristically have the minimum gap at the region where the vapor exists so that only slight modification of the burner is required.

The principal modes by which the microwave energy is conveyed to the fuel and flame are the TEM transmission line mode and the circular $TM_{01}$ waveguide mode. For heating of the fuel (see FIG. 1) a TEM mode is necessary, since typically the inside diameter of the fuel pipe has a diameter below cut-off for waveguide propagation at the microwave frequencies of interest. Hence an inner conductor is introduced (FIG. 1) to make the necessary transmission line. For conveying of the energy to the vapor and flame, one makes use of the naturally existing transmission line (FIG. 2) or circular waveguide in case of hollow burners. With reference to FIG. 2, it can be seen that, if the TEM mode is excited in the "Transmission Line" region, then a propagating or decaying $TM_{01}$ waveguide mode will be coupled into the "Waveguide" section, since the $TM_{01}$ waveguide mode has field components that most nearly match up to the TEM mode, i.e., for the TEM mode $$\vec{E} = E_\rho \hat{e}_\rho,\ E_\rho \propto \frac{1}{\rho} \text{ SIN } (\omega t - \kappa_o z)$$

$$\vec{H} = H_\rho \hat{e}_\rho,\ H_\rho \propto \frac{1}{\rho} \text{ SIN } (\omega t - \kappa_o z)$$

For the $TM_{01}$ mode:

$$\vec{E} = E_\rho \hat{e}_\rho + E_z \hat{e}_z,\ E_\rho \propto J_1 (2.4 \frac{\rho}{a}) \text{ SIN } (\omega t - \beta z)$$

$$E_z \propto J_o (2.4 \frac{\rho}{a}) \text{ COS } (\omega t - \beta z)$$

$$H = H_\rho \hat{e}_\rho,\ H_\rho \propto J_1 (2.4 \frac{\rho}{a}) \text{ SIN } (\omega t - \beta z)$$

$\kappa_o = \omega/c$ $\beta^2 = \kappa_o^2 - (2.4/a)^2$ a = radius of waveguide, z and $\rho$ are axial and radial dimensions Coupling between the coaxial line and circular guide is described, for example, in the *Waveguide Handbook*, N. Marcavitz, Section 4.3. Radiation from a circular waveguide excited in the $TM_{01}$ mode is given in Section 4.12. The information contained therein coupled with an understanding of the electrical properties of the fuel and flame plasma and a recognition for the need to couple microwaves to the fuel and plasma dictate the optimum dimensions to be used. A typical electric field distribution for heating of the vapor and flame plasma is shown in FIG. 2. Noteworthy is the high electric field in the region of the vapor and initial flame front. To give these considerations greater meaning, the following example is considered:

For vapor, Q may be calculated:

$$(V/\Delta V)_{Vapor} \simeq 250$$

$$(E^2_{AVE}/E^2)_{Vapor} \simeq \tfrac{1}{8}$$

Hence $$Q_{Vapor} \simeq 160 \times 250 \times \tfrac{1}{8} = 5{,}000$$

For the flame, Q may be calculated:

$$(V/\Delta V)_{Flame} \simeq 1{,}000$$

$$(E^2_{AVE}/E^2)_{Flame} \simeq \tfrac{3}{4}$$

Hence $$Q_{Flame} \simeq 4/3 \times 10^3 \times \tfrac{3}{4} = 1{,}000$$

The burner can be designed so that it has a high $Q_o$, i.e. $Q_o \simeq 5{,}000$. Hence, about 15 percent of the microwave power will be dissipated in wall heating, 15 percent will be used to heat the vapor, and about 70 percent will be used to heat and stimulate the flame plasma. These ratios can be changed by design of flame size if it is necessary, for example, to use a heavier weight fuel which needs more pre-flame vaporization heating.

With the embodiments described and the analysis presented, variations within the scope of the claims may be constructed by those skilled in the art. For example, conventional heating of the fuel in the supply pipe may be used to raise the temperature of the fuel to a point, and microwave heating according to the invention may be used to raise the temperature beyond that—to use both processes efficiently.

What is claimed is:

1. A system for preheating fuel for use with a hydrocarbon fuel burner having a combustion chamber, electrically conductive tubular fuel carrying means for carrying fuel to said combustion chamber, said tubular fuel carrying means terminating in a nozzle, air supply means terminating at said nozzle, to create at said nozzle a fuel vapor and air mixing region, and combustion ignition means in said fuel and air mixing region for igniting said fuel vapor for combustion in said chamber, said system comprising means for generating electromagnetic energy at microwave frequency, and means for electrically coupling said generating means to said electrically conductive tubular fuel carrying means to create a microwave electric field within said tubular fuel carrying means to heat said fuel.

2. The system of claim 1 in which said coupling means is a coaxial transmission line having a central and an outer conductor, further including an axial conductor within said tube coupled to said central conductor and located coaxially in said tubular fuel carrying means, said outer conductor being coupled directly to said tubular fuel carrying means.

3. The system of claim 2 in which said coaxial conductor is terminated in said nozzle and is electrically ungrounded.

4. The system of claim 1 further including said tubular fuel carrying means in which said tubular fuel carrying means is adapted to serve as a waveguide microwave conductor.

5. The system of claim 1 in which said air supply means is a conductive tube surrounding, and coaxial with, said tubular fuel supply means, said system further including means for generating electromagnetic energy at microwave frequency and a second coupling means coupled to said generating means, said second coupling means comprising a coaxial transmission line having a central and an outer conductor, said fuel supply means being coupled to said central conductor, and said air supply means being coupled to said outer conductor, to create a microwave electric field at said fuel vapor and air mixing region to heat said fuel vapor and stimulate said combustion.

6. The system of claim 5 in which said conductive air supply tube terminates in a mouth beyond said nozzle.

7. The system of claim 6 further including a tubular waveguide extending from said air supply tube mouth and electrically coupled thereto, into the region of combustion to create a microwave electric field in the region of combustion.

8. The system of claim 1 in which said fuel supply means is shaped as a waveguide, appropriate in dimension for the microwave frequency of said generating means.

* * * * *